US007997465B2

(12) United States Patent
Garofalo et al.

(10) Patent No.: US 7,997,465 B2
(45) Date of Patent: Aug. 16, 2011

(54) BABY SWADDLER

(76) Inventors: Anthony Garofalo, Belmar, NJ (US); Keefe Pirog, Belmar, NJ (US)

( * ) Notice: Subject to any disclaimer, the term of this patent is extended or adjusted under 35 U.S.C. 154(b) by 1036 days.

(21) Appl. No.: 11/891,549

(22) Filed: Aug. 13, 2007

(65) Prior Publication Data

US 2009/0045233 A1 Feb. 19, 2009

(51) Int. Cl.
*A47D 7/04* (2006.01)

(52) U.S. Cl. ..... 224/158; 224/222; 224/159

(58) Field of Classification Search ..... 224/158–159, 224/161, 222; 248/444; 108/43, 12, 19, 108/50.14; D6/406; 297/13, 251, 256.12; 5/655

See application file for complete search history.

(56) References Cited

U.S. PATENT DOCUMENTS 2,409,331 A * 10/1946 Wood ..... 224/159
4,052,944 A * 10/1977 Jennings ..... 108/43
4,235,472 A * 11/1980 Sparks et al. ..... 297/392
4,758,048 A * 7/1988 Shuman ..... 297/468
4,821,931 A * 4/1989 Johnson ..... 224/540
5,002,338 A * 3/1991 Gisser ..... 297/250.1
D318,579 S * 7/1991 Palmer ..... D6/406.6
5,154,649 A * 10/1992 Pender ..... 5/655
5,224,229 A * 7/1993 Smith ..... 5/655
5,335,968 A * 8/1994 Sheridan et al. ..... 297/250.1
5,581,833 A * 12/1996 Zenoff ..... 5/655
D380,727 S * 7/1997 Gilstrap ..... D12/425
6,061,854 A * 5/2000 Crowley ..... 5/655
RE37,239 E * 6/2001 Eisenberg ..... 108/43
6,564,408 B2 * 5/2003 Van Vuuren ..... 5/655
7,107,639 B2 * 9/2006 Taricani ..... 5/655
7,197,782 B1 * 4/2007 Veravanich ..... 5/655
D584,070 S * 1/2009 Jennings ..... D6/406.3
7,722,118 B2 * 5/2010 Bapst et al. ..... 297/256.12
2004/0182895 A1 * 9/2004 Paul ..... 224/159
2006/0200908 A1 * 9/2006 Dalton ..... 5/632

* cited by examiner

*Primary Examiner* — Justin Larson
*Assistant Examiner* — John Cogill
(74) *Attorney, Agent, or Firm* — Charles I. Brodsky

(57) ABSTRACT

A baby holder including a cushioned support having pairs of curved channel or indent undersides at substantially right angles to one another to allow resting of the support on the upper legs of a seated parent with the baby facing the parent's chest or sideways, and with its head supported by the cushion and its legs extended along the cushion.

9 Claims, 9 Drawing Sheets

BABY SWADDLER

CROSS-REFERENCE TO RELATED APPLICATIONS

NONE

STATEMENT REGARDING FEDERALLY SPONSORED RESEARCH OR DEVELOPMENT

Research and development of this invention and Application have not been federally sponsored, and no rights are given under any Federal program.

NONE

REFERENCE TO A MICROFICHE APPENDIX

NOT APPLICABLE

BACKGROUND OF THE INVENTION

1. Field of the Invention

This invention relates to the care of newborns, in general, and to an advanced form of baby swaddle care, in particular.

2. Description of the Related Art

As is well known and understood, "swaddling" is used to describe the art of snugly wrapping one's baby in a blanket for warmth and security. It can keep them from being disturbed by their own startle reflex, and it may even help them stay warm and toasty for the first few days of life until their internal thermostat kicks in. Most importantly, it can help to calm the baby to begin with.

Acknowledging that "swaddling" helps fussy babies sleep, assists in preventing facial scratches, makes breast feeding easier and enhances comfort for the newborn, the "swaddling" procedure generally includes the following:

a. Laying a blanket on a flat surface and folding down the top-right corner about 6 inches;

b. Placing the baby on its back with its head on the fold;

c. Pulling the corner near the baby's left hand across its body, tucking the leading edge under its back on the right side under the arm;

d. Pulling the bottom corner up under the baby's chin; and e. Bringing the loose corner over the baby's right arm, tucking it under the back on its left side.

Because the first few weeks in the wide-open world can be unsettling for the newborn (who's recently emerged from the closeness of the womb), swaddling the baby in a blanket can help it feel secure as it adjusts to its new environment.

However, it is widely accepted that "swaddling" is only effective for the first few weeks after birth. Specifically, typically after one month, "swaddling" (which inhibits movement) can restrict the baby's motor development. Holding a baby then in a sling-type carrier is another way to help the newborn feel safe and secure. Such "over-the-shoulder" baby holders provide contact pressure, motion, pleasure, warmth, security and sound similar to the womb that the newborn's nervous system requires. Because a baby is born in a state of physiological flexion—literally curled in a ball and not at all comfortable if straightened out—, those sling carriers available in the art tend to hold the baby in this flexed position, and stimulates the baby's ability to pull out of this little ball into extension. As the muscle tone in the neck and back is greatly enhanced in babies who are worn this way, the very act of carrying the infant helps the baby to pull out of the flexion position it is held comfortably in.

While "swaddling" the baby, and carrying it in a sling are effective, they lack the most critical ingredient of all—that of letting the baby know that it is in the hands of a person who nourishes it both physically and emotionally. That is, the baby who cannot feel, or see or hear its caregiver has been determined to possess more stress hormones circulating through its central nervous system, causing the baby to cry. Such stress has been found to irritate the immature digestive system causing the baby to spit-up, and increases diaper rash. Touching the baby has been noted to produce a positive effect on its digestive system.

But, almost equally as important is the fact that the "swaddling" and sling-carrying restrict the ability of the parent to interact with the new baby to begin with. The baby holder of the present invention will be seen to satisfy that need of the newborn, and from the time it weighs 7-8 pounds until the baby reaches some 25 pounds or more.

SUMMARY OF THE INVENTION

As will become clear from the following description, the holder of the invention provides a cushion support for resting and holding the baby on its back. Pairs of straps and alligator-type clips and clasps secure the baby in position, and additional securements allow the holder to be secured about the legs and thighs of the parent when sitting. As will be described below, curved channels or indents on the underside are included to provide for comfortable and secure resting of the holder on the upper legs of the seated parent in this manner, extending from the knee joint towards the waist. Handles are provided for ease of positioning and for carrying the holder, with the cushioning support being angled so as to orient the baby vertically, with the head on an upper portion of the holder and with the legs extended along a lower portion. When not in use, the holder of the invention can be easily mounted for storage in a hanging position.

BRIEF DESCRIPTION OF THE DRAWINGS

These and other features of the present invention will be more clearly understood from a consideration of the following description, taken in connection with the accompanying Drawings, in which.

DETAILED DESCRIPTION OF THE INVENTION

Figure 1:
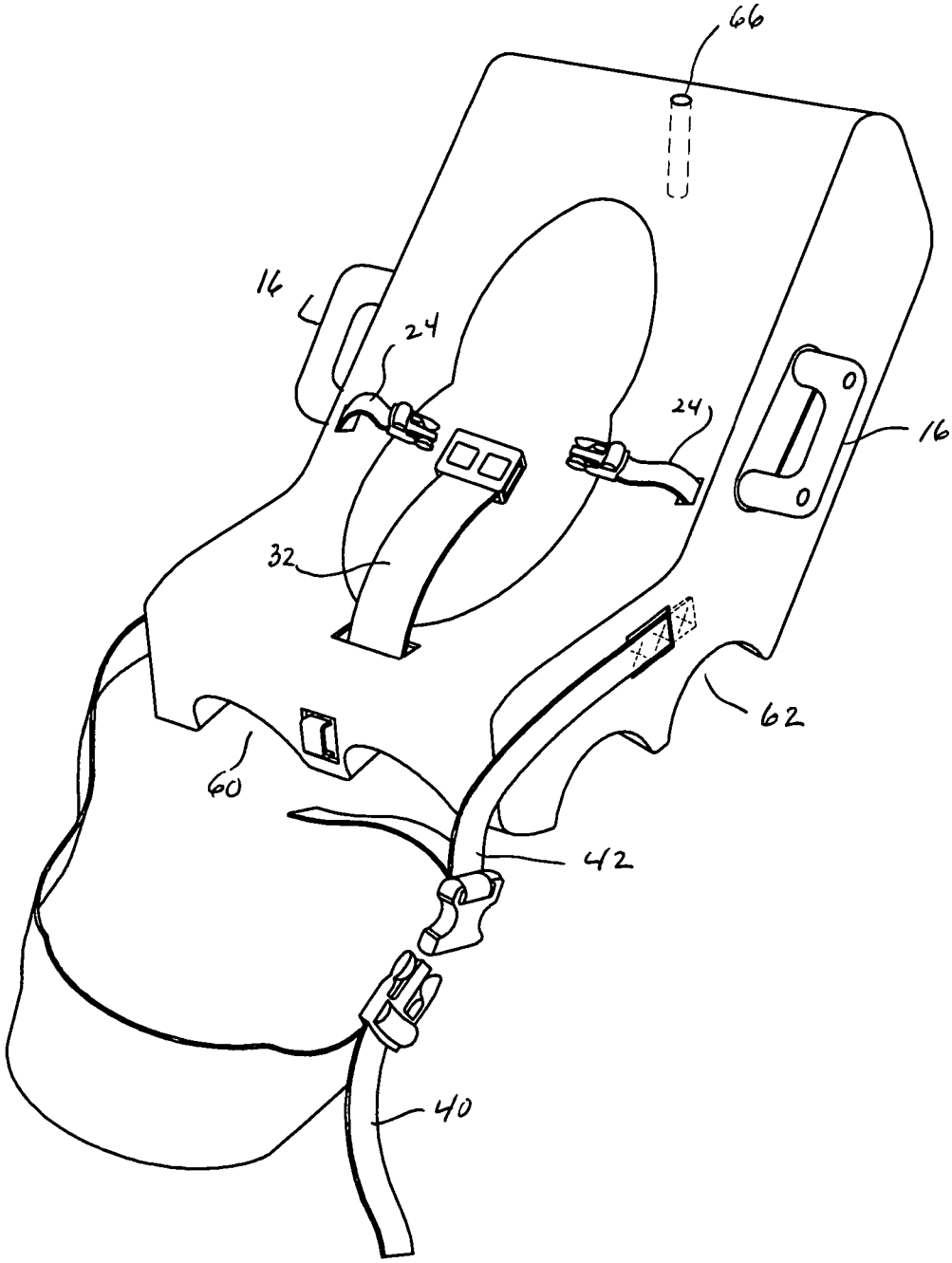
FIG. 1 is a pictorial view of the baby holder of the invention as it would appear ready to receive the baby.

The baby holder of the invention is shown at 10 in the Drawings as including a cushioned support 12 of any appropriate material and an overlying cover 14, preferably of cloth. A pair of handles 16 are joined to the support 12 by means of a fastening arrangement, shown as including screws 18 and receiving holes for them, 20. The cover 14 includes a pair of slots 22 on opposite sides to receive the handles 16 in allowing the handles to protrude through to be grasped. Slotted apertures 23 are provided on the cover 14 to allow a pair of straps 24 to extend through from the top surface of the cushioned support 12.

Figure 2:
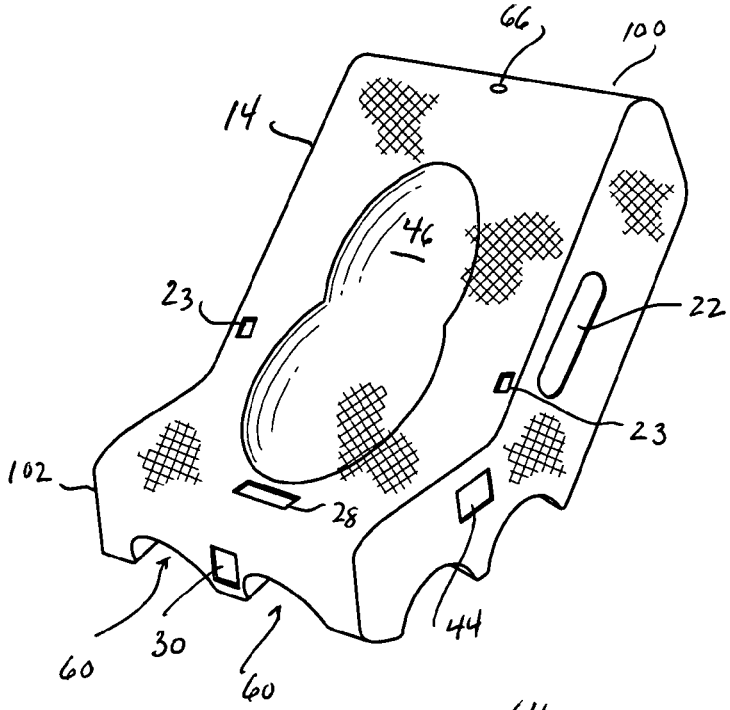
FIG. 2 is a break-away view of the baby holder of FIG. 1, showing its cushioning, an overlying cover, and curved cutouts for resting on the legs of a seated user.
Figure 2:
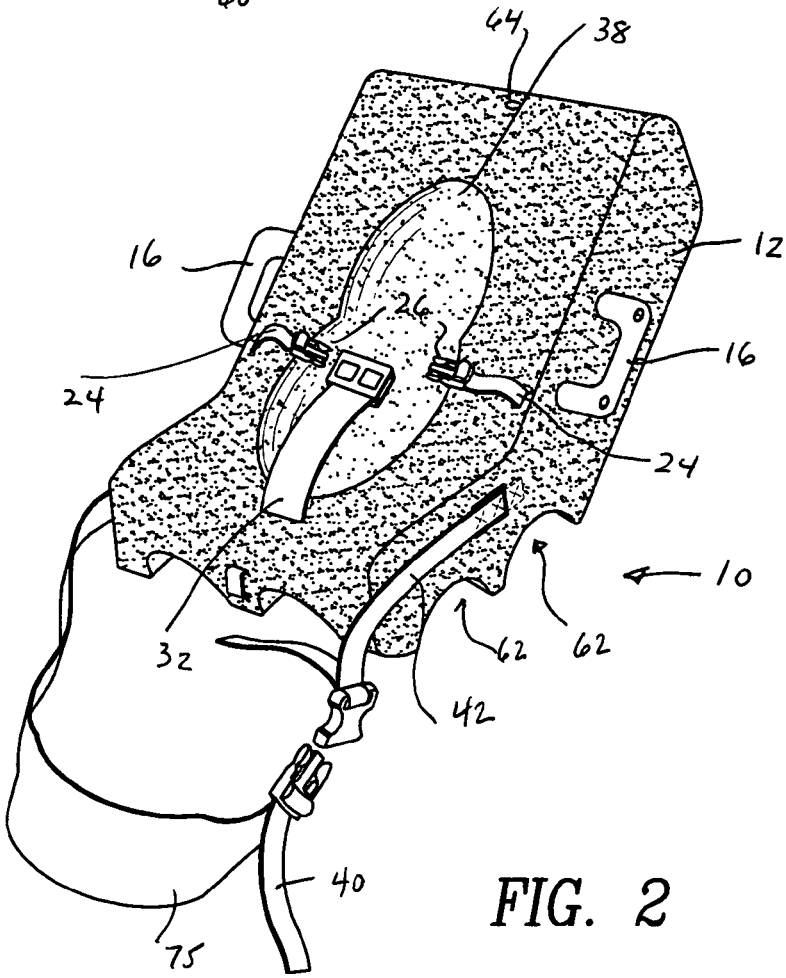

As shown in FIGS. 1 and 2, the straps 24 are arranged to be lengthened or shortened, and terminate in a pair of flexible alligator-type clips 26. Further slotted apertures 28, 30 are provided in the cover 14 to permit an adjustably lengthable strap 32 to extend upwardly through the cover 14 from the cushioned support 12. Such strap 32 terminates in a clasp 34 to receive the alligator-type clips 26 of the straps 24. The cover 14 additionally includes a cut-out 46 overlaying a similarly shaped cut-out 38 in the support 12, both being configured to receive the baby or infant to be placed thereupon, with its head adjacent the edge of the holder shown at 100, and with its legs extending towards the edge 102. As will be appreciated, joining the components provides the overall appearance of the baby holder of FIG. 1, as so far described.

Figure 3:
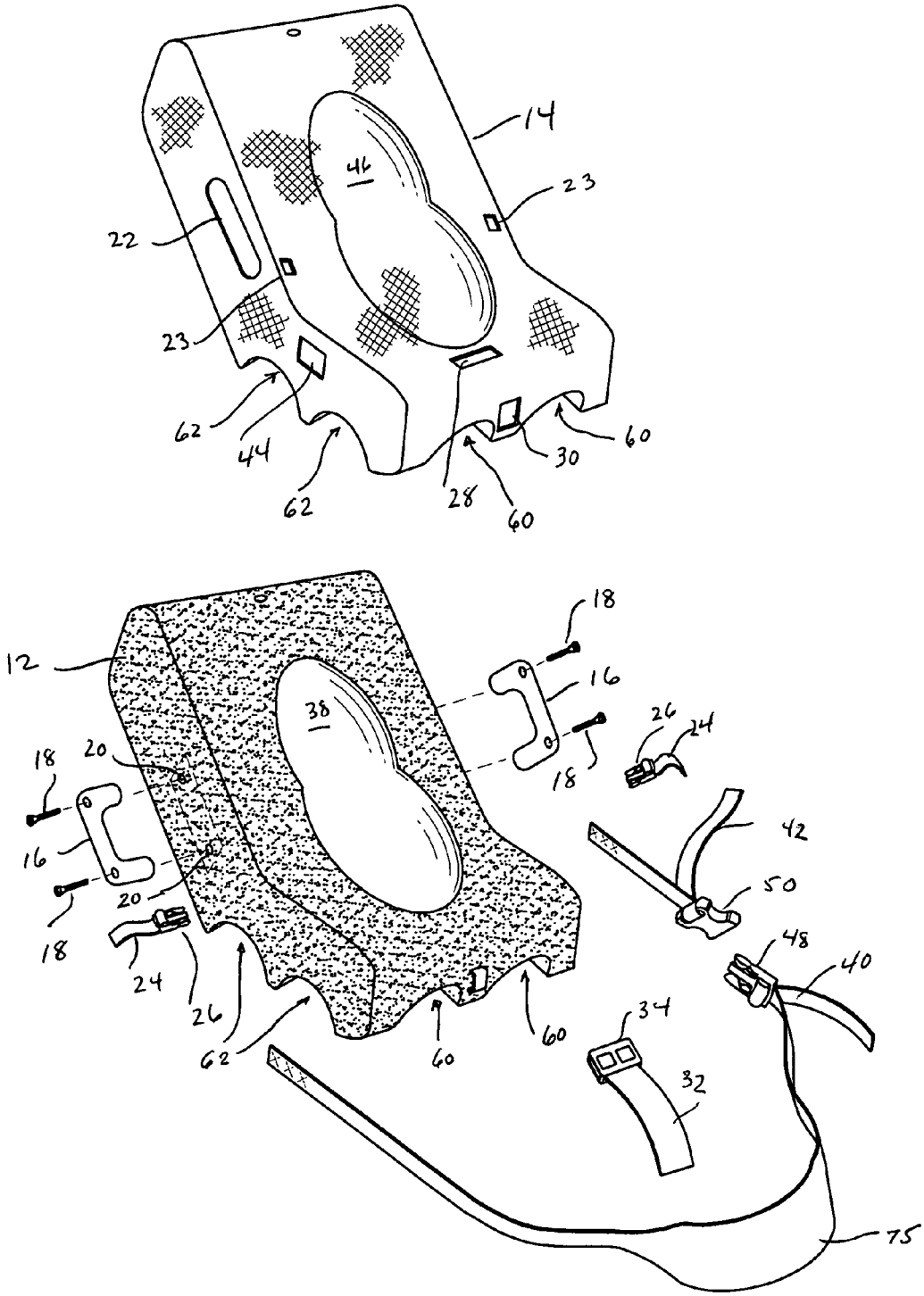
FIG. 3 is a pictorial view of a further breakaway view of the baby holder helpful in an understanding of its construction.
Figure 4:
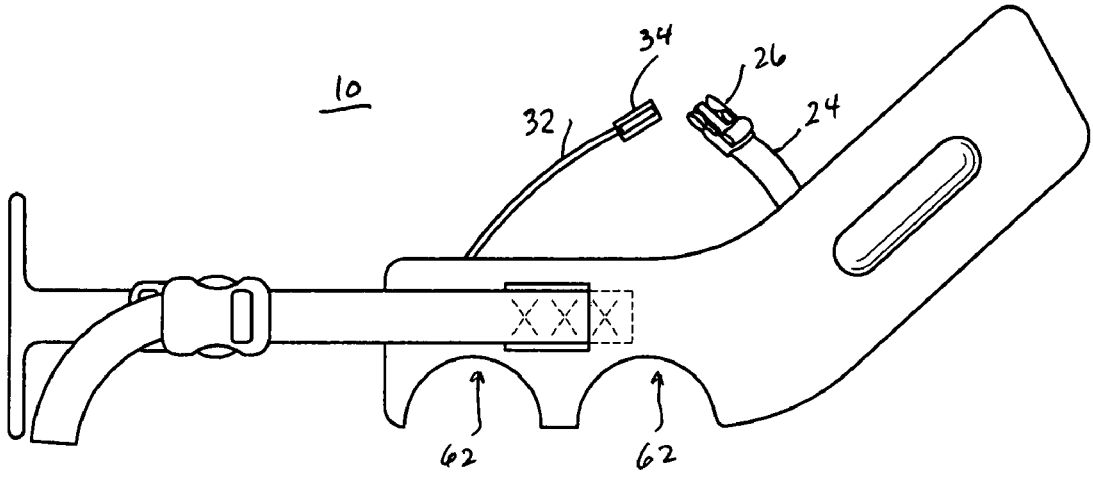
FIG. 4 is a left-side view of the baby holder of FIG. 1, a right-side view being a mirror image.
Figure 5:
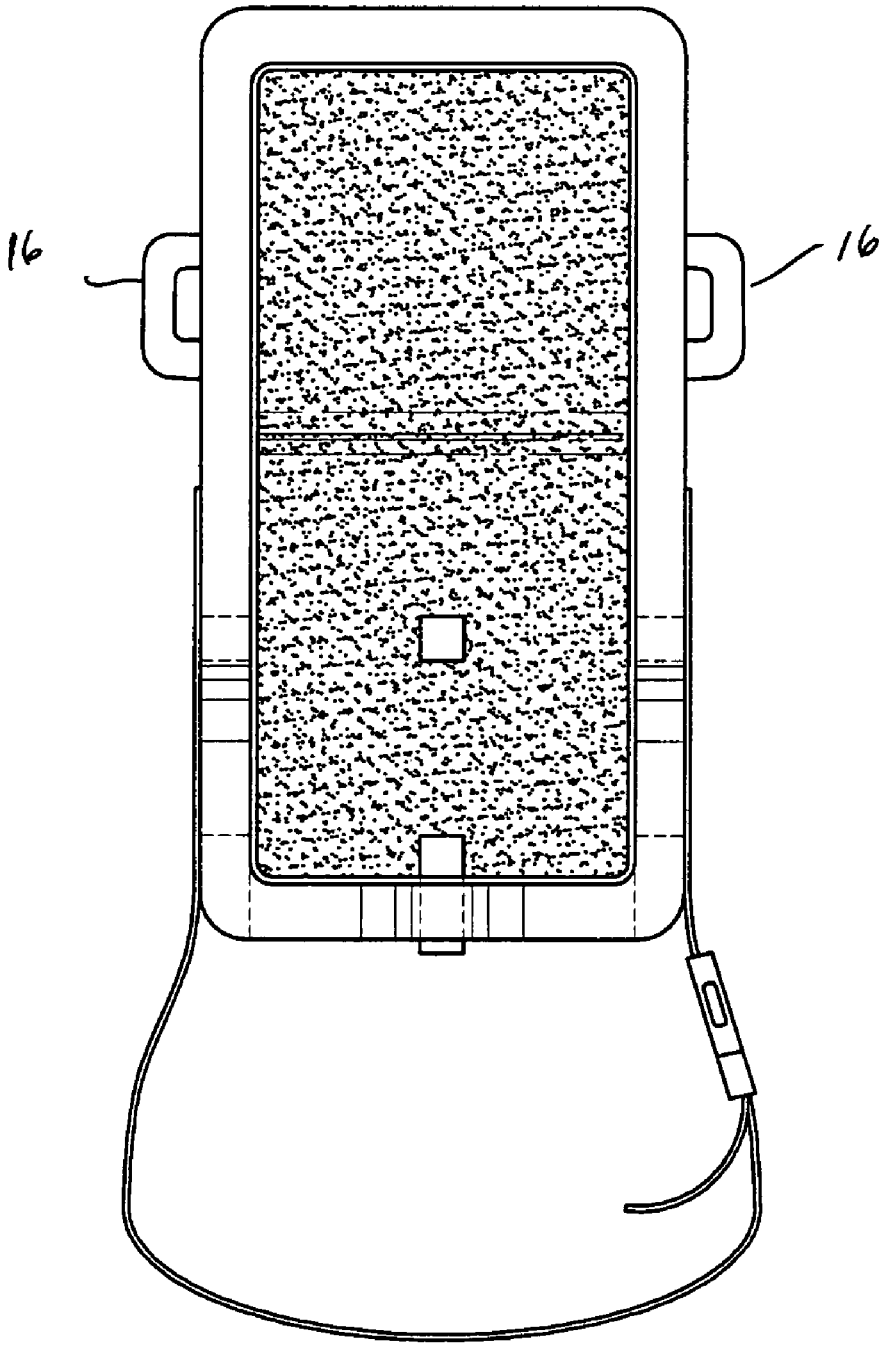
FIG. 5 is a rear view of the baby holder.
Figure 6:
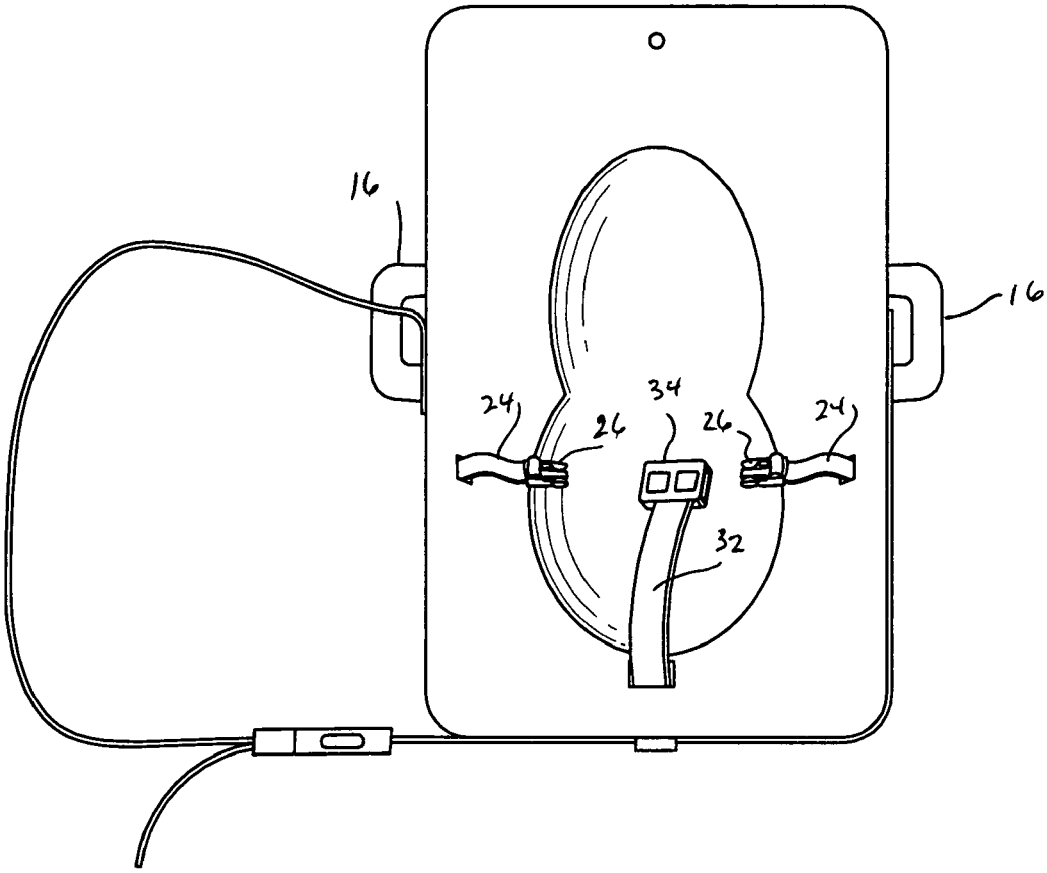
FIG. 6 is a top view of the baby holder of the invention.
Figure 7:
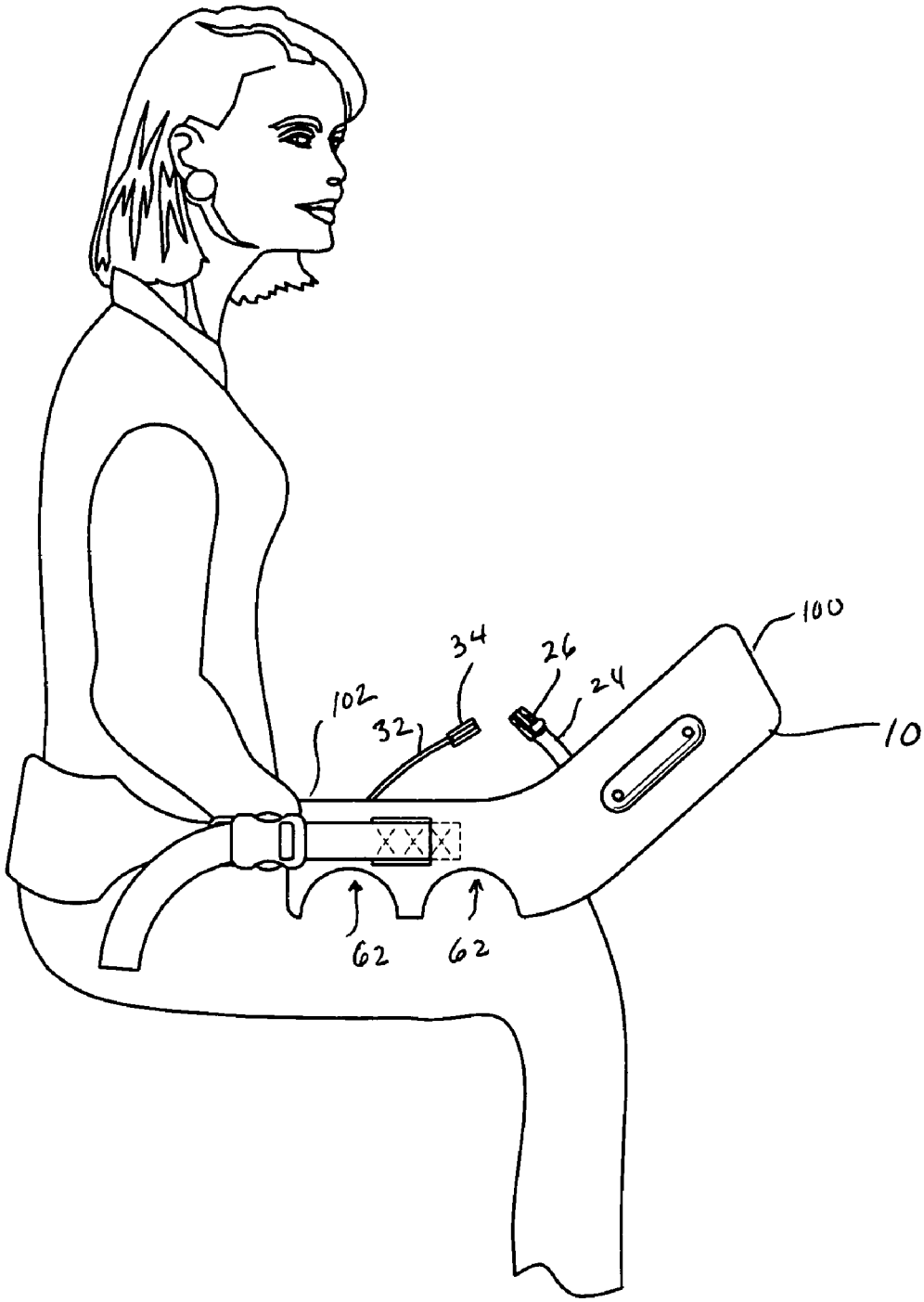
FIGS. 7 and 8 are helpful in an understanding of a manner of using the baby holder invention.
Figure 8:
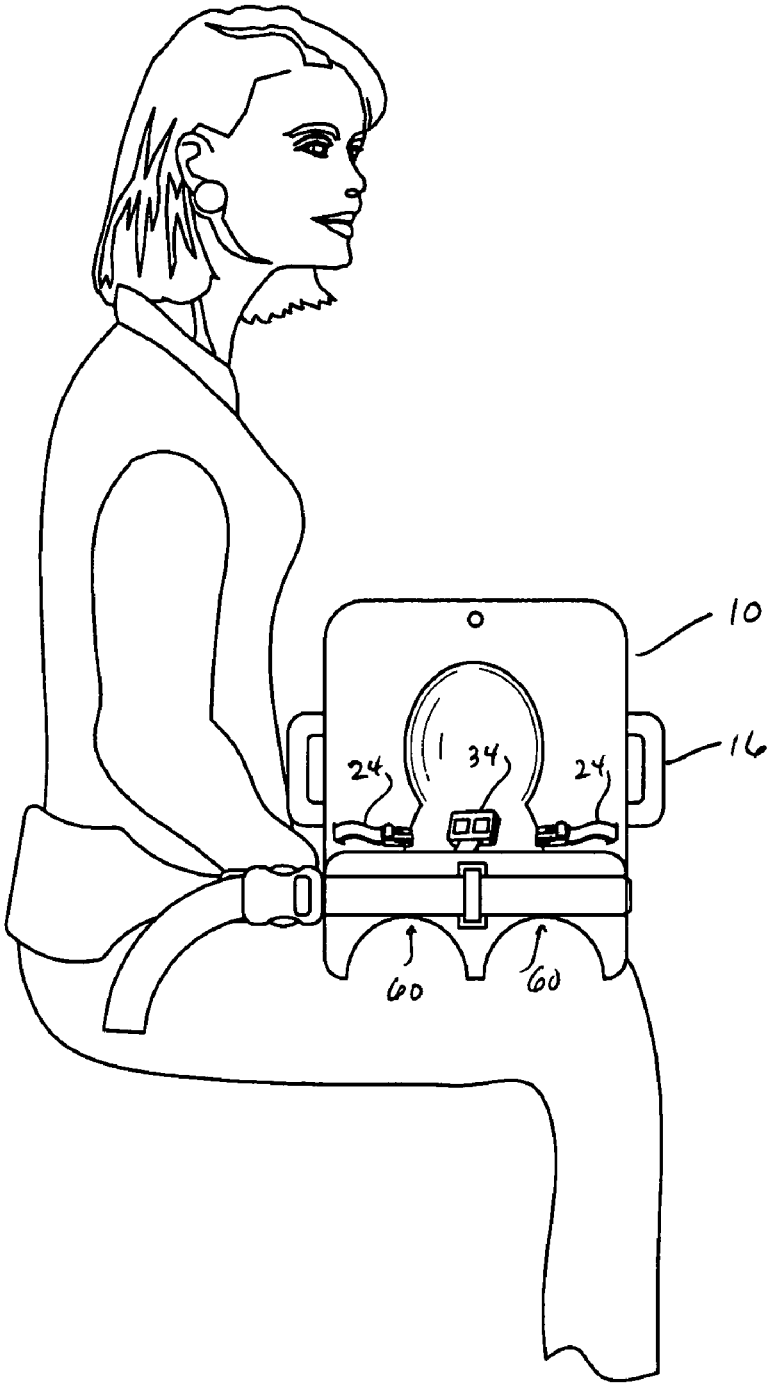

The baby holder of FIGS. 1-3 illustrate three additional features of the invention. First, a pair of additional straps 40, 42 extend from the sides of the cushion support 12 and through further slots 44 in the cover 14, with one strap terminating in an alligator-type clip 48, with the other strap terminating in a clasp 50, and with either or both straps being of adjustable length. Such straps 40 and 42, and the alligator clip-clasp combination 48 and 50 serve in securing the cushion support about the waist of a seated parent, as shown in FIGS. 7 and 8. Moreover, the strap 40 is illustrated as being of much greater linear dimension (at 75) to comfortably fit about the hip and back area in providing a comfortable wearing position. Tightening or loosening the straps 40, 42 allows for a wearing adjustment in meeting the parent's needs for comfort.

In accordance with the teachings of the present invention, furthermore, both the cushion support 12 and the cover 14 are provided with pairs of curved channels or indents 60, 62, substantially oriented at right angles to one another for resting the support 12 and the baby holder 10 on the parent's legs, adjacent the knee joint and extending back towards the torso or waist area. Specifically, the curved channels 60 of FIGS. 1 and 7 will be appreciated in allowing the holder 10 to rest on the parent's upper legs in the front, to allow the supported baby to face the parent. The curved channels 62, on the other hand, allow the holder 10 to be rotated horizontally 90° either way, to allow the supported baby to face sideways (FIGS. 1 and 8). In the arrangements of FIGS. 7 and 8, the curved channels 60, 62 rest on the upper leg of the parent.

As will be appreciated, in use, the baby is placed on its back in the cut-outs 36 and 38, and the clips 26 are secured with the clasp 34 to hold the baby in place. Grasping the handles 16 allows for placement of the holder 10 and the baby on the seated parent's upper legs in the configuration of either FIG. 7 or 8. The clip 48 and the clasp 50 are then secured for tying as a belt about the parent's waist, orienting the segment 75 for comfort. This then allows for holding the baby in front (FIG. 7) or sideways (FIG. 8), and playing with it while the parent is sitting, relaxing on a chair, sitting in bed watching television, sitting at a personal computer, or when sitting on a couch. Both the baby and belt are secured so that neither the holder nor the baby would sway from side-to-side or fall over.

Figure 9:
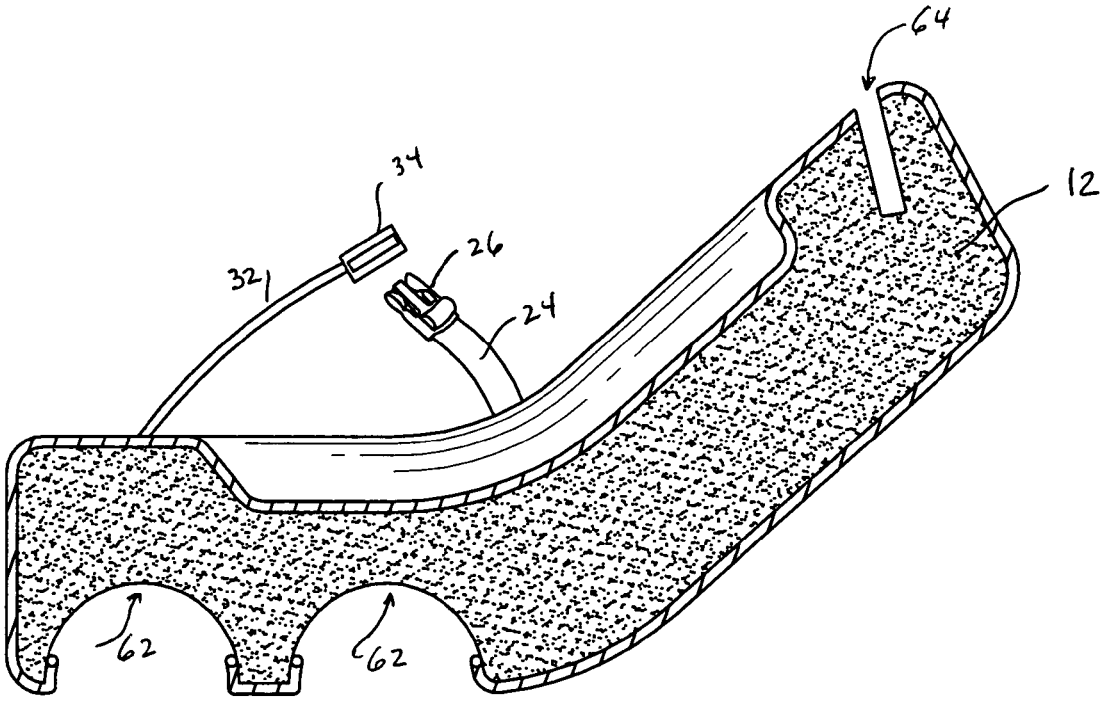
FIG. 9 is a sectional side view showing the cushioning afforded to the invention and a pair of its curved leg support channels or cutouts.

When it is time to return the baby to its cradle or bed, the various clips, clasps and straps are simply released, and the baby is then able to be lifted out of the holder. Aperture 64 provided in the cushioned support 12 (FIGS. 2 and 9) permits hanging the holder 10 from a screw or nail extending through the corresponding aperture 66 in the cover 14 (FIG. 2).

While there have been described what are considered to be preferred embodiments of the present invention, it will be readily appreciated by those skilled in the art that modifications can be made without departing from the scope of the teachings herein. For at least such reason, therefore, resort should be had to the claims appended hereto for a true understanding of the scope of the invention.

What is claimed is:

1. A holder to support a baby or infant, comprising:

a support including a cushioned top surface forming upper and lower portions to hold a baby or infant on its back;

with the upper portion of the support being upwardly angled with respect to the lower portion of the support to orient the baby or infant vertically in supporting the back of its head on the upper portion and the back of its legs on the lower portion;

with the lower portion of the support having first and second downwardly curved channels within an underside surface thereof, each extending between front and rear edges of the lower portion; and with the lower portion of the support being dimensioned to span said first and second channels across the upper legs of a sitting user between his/her knees and waist area in facing the head of the baby or infant being supported with the lower portion of the support having third and fourth downwardly facing curved channels within said underside surface, each extending between side edges of said lower portion;

wherein the downwardly curved first and second channels extend parallel to one another, wherein the downwardly curved third and fourth channels extend parallel to one another, and wherein the downwardly curved first and second channels extend at right angles to the downwardly curved third and fourth channels;

wherein each channel has a substantially uniform semicircular shape through its entire length.

2. The holder of claim 1, also including a cover atop the top surface of the support.

3. The holder of claim 2 wherein said cover is of a cloth fabrication.

4. The holder of claim 2, additionally including first and second adjustable length connectable straps upwardly extending from opposing side surfaces of the upper portion of the support and of a length to span across a baby or infant laid on its back on the support.

5. The holder of claim 4, further including a third adjustable length strap connectable with said first and second straps to secure the baby or infant on its back on the support.

6. The holder of claim 5, also including fourth and fifth adjustable length straps extending from the side edges of the lower portion of said support, each of a length to gird and connect about the waist of a user across whose legs the holder is spanned.

7. The holder of claim 6, further including a pair of handles outwardly graspable from opposing side surfaces of the portion of the support.

8. The holder of claim 6 wherein one of said fourth and fifth adjustable length straps terminates in a clip to connect with the other of said fourth and fifth adjustable length straps terminating in a clasp.

9. The holder of claim 5 wherein each of said first and second adjustable length straps terminate in a clip to connect with said third adjustable length strap terminating in a clasp.

* * * * *